United States Patent [19]

Blase et al.

[11] Patent Number: 4,465,557

[45] Date of Patent: Aug. 14, 1984

[54] GAS TRANSFERRING APPARATUS IN COKE OVEN

[75] Inventors: Manfred Blase, Essen; Klaus Dahl, Gelsenkirchen; Manfred Galow, Essen, all of Fed. Rep. of Germany; Johann Zendron, Linz, Austria

[73] Assignees: Didier Engineering GmbH, Essen, Fed. Rep. of Germany; Voest-Alpine Aktiengesellschaft, Linz, Austria

[21] Appl. No.: 374,263

[22] Filed: May 3, 1982

[30] Foreign Application Priority Data

May 13, 1981 [DE] Fed. Rep. of Germany ..... 3118941
Feb. 12, 1982 [DE] Fed. Rep. of Germany ..... 3204991

[51] Int. Cl.[3] ..... C10B 25/24; C10B 27/04; C10B 31/04; C10B 43/04

[52] U.S. Cl. ..... 202;241; 202/251; 202/263; 202/269

[58] Field of Search ..... 202/241, 251, 263, 269; 15/93 A; 414/160, 164

[56] References Cited

U.S. PATENT DOCUMENTS

| | | | |
|---|---|---|---|
| 1,485,914 | 3/1924 | Greene | 202/263 |
| 3,281,880 | 11/1966 | Bender | 15/93 A |
| 3,709,387 | 1/1973 | Kinzler et al. | 202/251 |
| 3,791,320 | 2/1974 | Gidick | 202/263 |
| 4,207,145 | 6/1980 | Hatters et al. | 202/263 |
| 4,314,889 | 2/1982 | Kwasnik et al. | 202/263 |

FOREIGN PATENT DOCUMENTS

| | | | |
|---|---|---|---|
| 1105380 | 4/1961 | Fed. Rep. of Germany | 202/263 |
| 2504265 | 6/1976 | Fed. Rep. of Germany | 202/241 |
| 2700984 | 7/1978 | Fed. Rep. of Germany | 202/263 |
| 2732245 | 8/1979 | Fed. Rep. of Germany . | |
| 2920406 | 11/1980 | Fed. Rep. of Germany . | |
| 7409150 | 1/1975 | Netherlands | 202/263 |
| 7700734 | 8/1977 | Netherlands | 202/263 |

*Primary Examiner*—Bradley Garris
*Attorney, Agent, or Firm*—Wenderoth, Lind & Ponack

[57] ABSTRACT

An apparatus for transferring between chambers of a coke oven charging gases which develop during the charging of the chambers, while preventing the escape of the gases to the surrounding environment, includes first and second covers mounted for movement between first positions closing charging openings through an oven roof and second positions uncovering such openings. Ducts surround the peripheries of the first and second openings, such ducts being filled with a displaceable sealing medium. First and second housings form respective first and second compartments enclosing the first and second covers, respectively, at all positions thereof. The first and second covers have apron members extending into the displaceable sealing medium in the respective ducts when the covers are in the first positions thereof. The housings have at lower portions thereof seals for sealing the compartments from the exterior. First and second lifting devices are associated with the respective housing to move the first and second covers, respectively, within the respective compartments between the first and second positions of the covers. A transfer duct extends between the first and second compartments for, upon the covers being moved from the first positions thereof, transferring charging gases between the chamber openings via the compartments.

40 Claims, 3 Drawing Figures

GAS TRANSFERRING APPARATUS IN COKE OVEN

BACKGROUND OF THE INVENTION

The present invention relates to an apparatus for transferring between chambers of a coke oven charging gases which develop during the charging of the chambers while preventing the escape of the gases to the surrounding environment. The present invention also relates to a coke oven installation of the type including openings extending through an oven roof into respective oven chambers, including an apparatus for transferring between the chambers charging gases which develop during the charging of the chambers while preventing the escape of the gases to the surrounding environment.

West German DE-OS No. 29 20 406 discloses a transfer installation wherein a transfer pipe is mounted on a movable cart on the roof of the oven to be raised or lowered. The transfer pipe has downwardly extended ends which are equipped with ring-shaped strips which can be inserted into a water seal of a rising main pipe section after covers closing the chamber openings have been removed from such openings. During the time between the removal of the covers and the attachment of the transfer pipe, crude gases can escape to the surrounding atmosphere. Gases also will escape into the atmosphere following the removal of the transfer pipe and before the covers are placed back in the chamber openings. Such gas escape is undesirable for obvious reasons.

In addition to the above mentioned type of apparatus including a movable transfer installation, stationary transfer installations are known. In such known stationary transfer installations, two furnace chambers are connected by a stationary transfer pipe. Inside the transfer pipe a slide valve or flap is provided to separate the two furnace chambers after a filling operation. However, the slide valve or flap will not permanently guarantee a gas-tight separation of the two furnace chambers, because such slide valve or flap is exposed to crude gases during the entire coking operation. This causes condensation of tar vapors in the transfer pipe and on the slide valve or flap. This in turn causes a considerable build-up of deposits which precludes gas tightness and which requires a routine cleaning and removal operation.

SUMMARY OF THE INVENTION

With the above discussion in mind, it is a primary object of the present invention to provide an improved apparatus for transferring between chambers of a coke oven charging gases which develop during the charging of the chambers while preventing the escape of the gases to the surrounding atmosphere, as well as a coke oven installation employing such improved transferring apparatus.

It is a further object of the present invention to provide such an improved apparatus and installation which is designed such that at no time can gases escape from the oven chambers to the surrounding environment.

It is a still further object of the present invention to provide such an improved apparatus and installation which is designed to ensure a high degree of gas tightness between the furnace chambers.

These objects are achieved in accordance with the present invention by the provision, in accordance with one aspect of the present invention, of an apparatus for transferring between coke oven chambers charging gases which develop during the charging of the chambers while preventing the escape of the gases to the surrounding environment, such apparatus including covers adapted to be mounted for movement between first positions adapted to close respective openings extending through a coke oven roof into respective coke oven chambers, and second positions adapted to uncover such openings. The apparatus includes ducts adapted to peripherally surround the openings, the ducts being filled with a displaceable sealing medium. Housings form compartments enclosing the respective covers at all positions thereof. Each cover has a respective apron member extending into the displaceable sealing medium in the respective duct when such cover is in the first position thereof. Each housing has at a lower portion thereof means for sealing the compartment thereof from the exterior atmosphere. Each housing has associated therewith a lifting means for moving the respective cover within the respective compartment between the first and second positions thereof. A transfer duct extends between the compartments for, upon the covers being moved from the first positions thereof, transferring charging gases between the chamber openings via the compartments.

In accordance with a further aspect of the present invention, a coke oven installation including first and second openings extending through an oven roof into respective oven chambers includes such transferring apparatus.

By these arrangements, the covers, in all positions thereof, are sealed from the surrounding atmosphere. Thus, when the transfer apparatus is stationary, i.e. fixed to the oven roof, the covers are enclosed by the respective housings in all positions of the covers. When the transferring apparatus is removably connectable to the oven roof, the covers are enclosed within the respective housings during all positions of the covers, when the transferring apparatus is in the installed position. Even when the transferring apparatus is removed from the oven roof, the covers are sealed when in the positions covering the chamber openings, thereby preventing escape of gases to the surrounding atmosphere. The covers are moved to the raised, uncovering positions within the respective compartments, thereby enabling flow of gases between the chambers, but preventing the gases from escaping to the surrounding environment.

When the transferring apparatus is stationary and fixed to the furnace roof, preferably the lifting devices are connected to the covers in the interiors of the respective compartments. When the transferring apparatus is removably mounted on the oven roof, the lifting devices are removably connectable to the covers in the interiors of the compartments, for example by coupling or clutching devices.

In accordance with a further feature of the present invention, an upper portion of each housing has a cover seal at a position to sealingly contact the respective cover when the cover is in the raised, open position. Each cover seal surrounds a hole through which the lifting device slidably extends, thereby providing a further seal to prevent the escape of gases to the surrounding atmosphere when the cover is in the raised, opened position.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
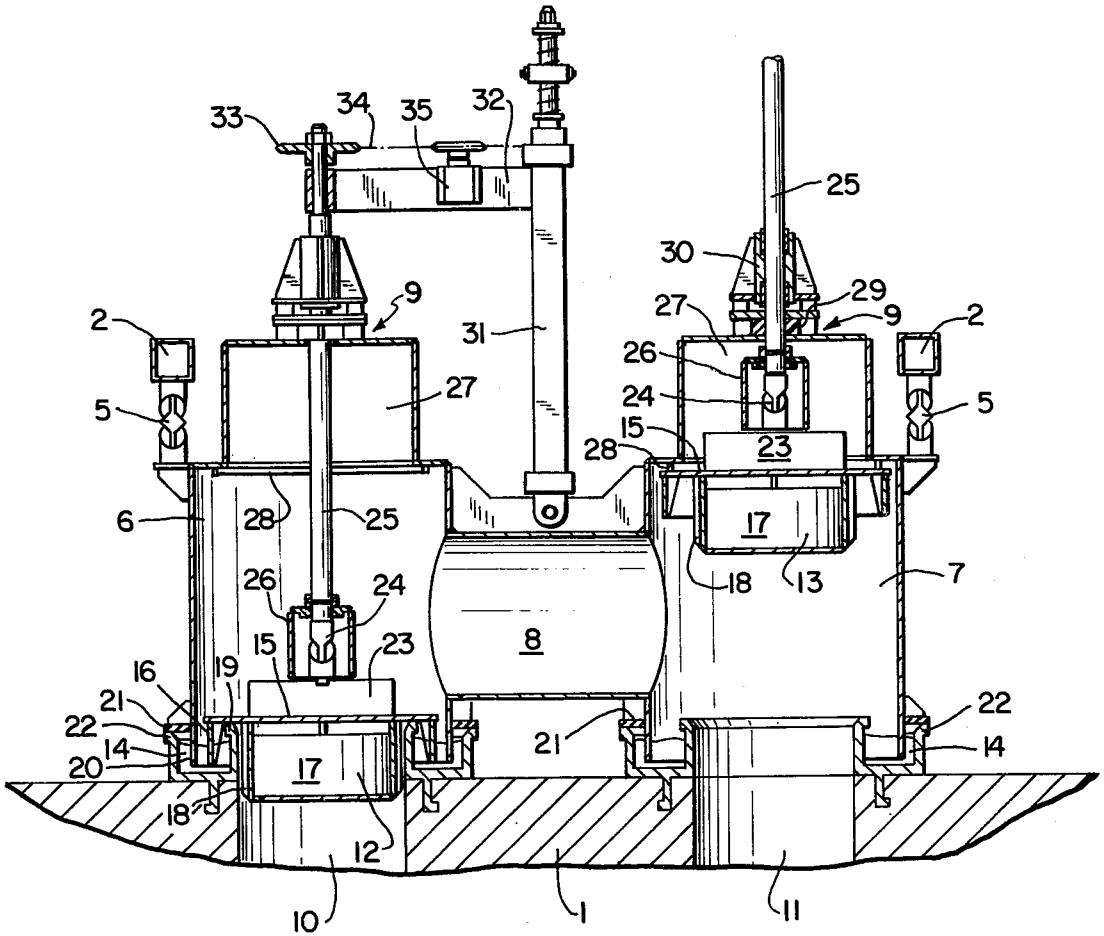
FIG. 1 is a cross sectional view taken approximately along line I—I of FIG. 2, showing a first embodiment of the present invention.
Figure 2:
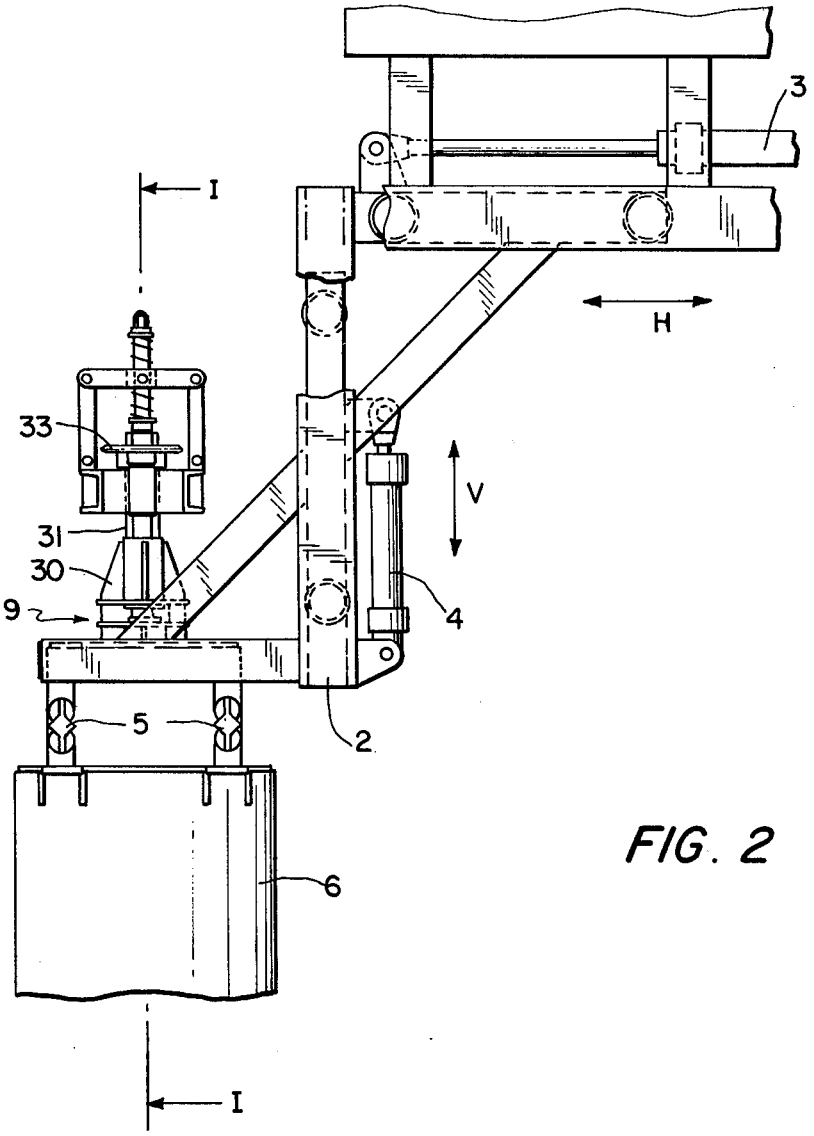
FIG. 2 is an elevation view of the installation of FIG. 1, with the portion of the coke oven shown in FIG. 1 not being shown in FIG. 2.

With reference now to FIGS. 1 and 2 of the drawings, a first embodiment of the present invention will be described in detail. Thus, a coke oven includes at least first and second chambers covered by an oven roof 1 having therethrough openings 10 and 11, for example charging or filling openings. A framework 2 is movably mounted above oven roof 1, and for example supports a filling cart, shown partially at the top of FIG. 2. The transferring apparatus of the present invention is connected to and supported by framework 2, for example by ball joints or universal joints 5. The framework 2, and thereby the transferring apparatus, may be moved horizontally, in the directions of arrow H, for example by means of hydraulic cylinder 3. The framework 2, and thereby the transferring apparatus, also can be moved vertically in the directions of arrow V, for example by means of hydraulic cylinder 4.

Caps or covers 12, 13 are movable between first positions closing openings 10 and 11, respectively, and second positions uncovering the respective openings. In FIG. 1, cover 12 is shown in the closed position closing opening 10, and cover 13 is shown in the raised or opened position uncovering opening 11. Surrounding each opening 10, 11 is a duct 14 filled with a displaceable sealing medium, for example water, oil or a powder. Covers 12, 13 extend through respective ducts 14 into openings 10, 11, respectively, when in the closed positions thereof. Each cover 12, 13 includes an upper cover plate 15 having depending downwardly therefrom a peripheral apron member 16 which extends into the displaceable sealing medium in the respective duct 14 when the respective cover is in the closed position thereof, as shown with respect to cover 12 in FIG. 1. This creates a seal which prevents escape of gases from the respective coke oven chamber through the cover.

Associated with each cover is a housing forming a respective compartment 6 or 7 enclosing the respective cover 12 or 13 at all positions thereof, i.e. both at the closed position or the raised position. The housings forming compartments 6, 7 are attached to framework 2 via the universal joints 5 and are movable therewith. Thus, in this embodiment of the present invention, the transferring apparatus is removably mountable on the oven roof 1. A lower portion of each housing has an apron 20 which extends into the displaceable sealing medium in the respective duct 14, thereby creating a seal between the exterior and the interior of the housing. Each housing further has a lip or flange 21 resting and abutting on an upper portion of an outer wall 22 of the respective duct 14. Thereby the respective housing is supported, and additionally the downward extension of the respective apron 20 into the displaceable sealing medium is limited. Furthermore, upper plate 15 of each of the covers rests on the upper edge of a wall 19 of the respective duct 14, thereby supporting the cap and limiting the extension of the respective apron 16 into the displaceable sealing medium in the respective duct.

Each housing has extending therethrough a respective lifting device 9. Each lifting device 9 includes a coupling device 23 removably connectable to the respective cover 12, 13 at a position within the respective compartment 6, 7. A rod 25 extends movably upwardly through the respective housing, and a lower end of rod 25 is connected, for example by gimbles with the aid of a ball joint or universal joint 24, with the respective coupling device 23. A sleeve 26 surrounds the universal joint 24 to protect joint 24 from the gaseous environment and also limits potential vibratory movement of coupling device 23. In a particularly advantageous arrangement, upper plate 15 of each cover may be formed of a magnetically attractable material, for example iron, and coupling device 23 may be an electromagnet capable of attracting cover plate 15. At the top of each housing is a casing 27 which houses sleeve 26, joint 24 and electromagnet 23 when the respective lifting device is in the raised position, shown with respect to cover 13 in FIG. 1. To the upper outer end of rod 25 is connected a structure for raising and lowering rod 25, coupling device 23 and the respective cover. One possible such raising and lowering structure is shown in FIGS. 1 and 2 and includes a hydraulic cylinder 31 mounted between the housings defining compartments 6, 7. Attached to cylinder 31 is a carrier device 32 connected to and supporting lifting rod 25 in such a manner that rod 25 is vertically fixed with respect to carrier device 32 but is rotatable with respect thereto about the axis of rod 25. A wheel or gear 33 mounted to the top of rod 25 is adapted to be rotated by motor 35 and drive belt or chain 34. Thus, movement of cylinder 31 raises or lowers rod 25, while operation of motor 35 can rotate rod 25 about the axis thereof. FIG. 1 shows support only of that rod 25 associated with cover 12. However, it is to be understood that another similar structure may be provided to support rod 25 associated with cover 13, such that operation of cylinder 31 simultaneously raises or lowers both covers 12 and 13. Alternatively, separate drive mechanisms could be provided for each lifting rod 25 and the respective cover.

Each cover 12, 13 includes a plug 17 extending into the respective duct and opening. Each plug 17 has on the exterior thereof scrappers 18. By rotation of rod 25, electromagnet 23 and the respective cover, scrappers 18 remove deposits which might accummulate on the inner surfaces of the respective duct 14 and opening 10 or 11.

Each housing defining compartments 6 and 7 has at an upper portion thereof a cover seal 28 at a position to sealingly contact the upper surface of cover plate 15 when the respective cover is in the raised position thereof. This relationship is shown with respect to cover 13 in FIG. 1. Rod 25 extends through casing 27 by means of a guide bearing or bushing 30 and a gland sealing ring 29 which provides a secondary seal enclosing the interior of the respective compartment when the cover is in the closed position thereof. When the cover is in the raised position thereof, the seal of cover seal 28 with cover plate 15 provides a primary seal to prevent escape of gases from compartments 7 through sealing ring 29.

A pipe extends between first and second compartments 6, 7 to form a transfer duct 8 therebetween to enable transferring of charging gases between the chamber openings 10, 11 when the covers 12, 13 are in the raised positions.

The embodiment illustrated in FIGS. 1 and 2 operates as follows.

The filling cart and transferring apparatus are moved to a furnace chamber to be filled. There the housings defining compartments 6, 7 are aligned and lowered, with the aid of framework 2, over a cap 12/13 of a furnace chamber to be filled and a cap 13/12 of an adjacent furnace chamber. Upon lowering of the housings, flanges 21 rest on walls 22 of duct 14, with aprons 20 extending into the displaceable sealing medium in ducts 14, thereby sealing the interiors of the compartments 6, 7 from the surrounding environment. Universal joints 5 enable a precise alignment of flanges 21 and walls 22. Then, rods 25 are lowered such that electromagnets 23 are moved onto the tops of caps 12, 13. Universal joints 24 ensure that electromagnets 23 will lie flat against cover plates 15. Then, rods 25 are lifted, and if necessary rotated, thereby releasing covers 12, 13 from openings 10, 11. The covers 12, 13 are then moved into the raised position, shown at the right side of FIG. 1, such that cover plates 15 sealingly contact cover seals 28. Again, universal joints 24 ensure this tight sealing contact. Seals 28 form first seals preventing the escape of crude gases. However, any crude gases which escape pass seals 28 are prevented from entering the surrounding atmosphere by gland sealing rings 29 forming second seals.

Gases can now travel from one furnace chamber through the respective compartment 6 or 7, then through transfer duct 8, the other compartment 7 or 6, and into the other furnace chamber without the danger of such gas escaping into the surrounding atmosphere.

In order to maintain the necessary water level in ducts 14, when the displaceable sealing medium is water, water infeed pipes, or if necessary, water drain pipes may be connected to walls 22. It is to be understood however, that similar supplies or drains could be provided when the displaceable sealing material is other than water, for example a powder material or oil.

Figure 3:
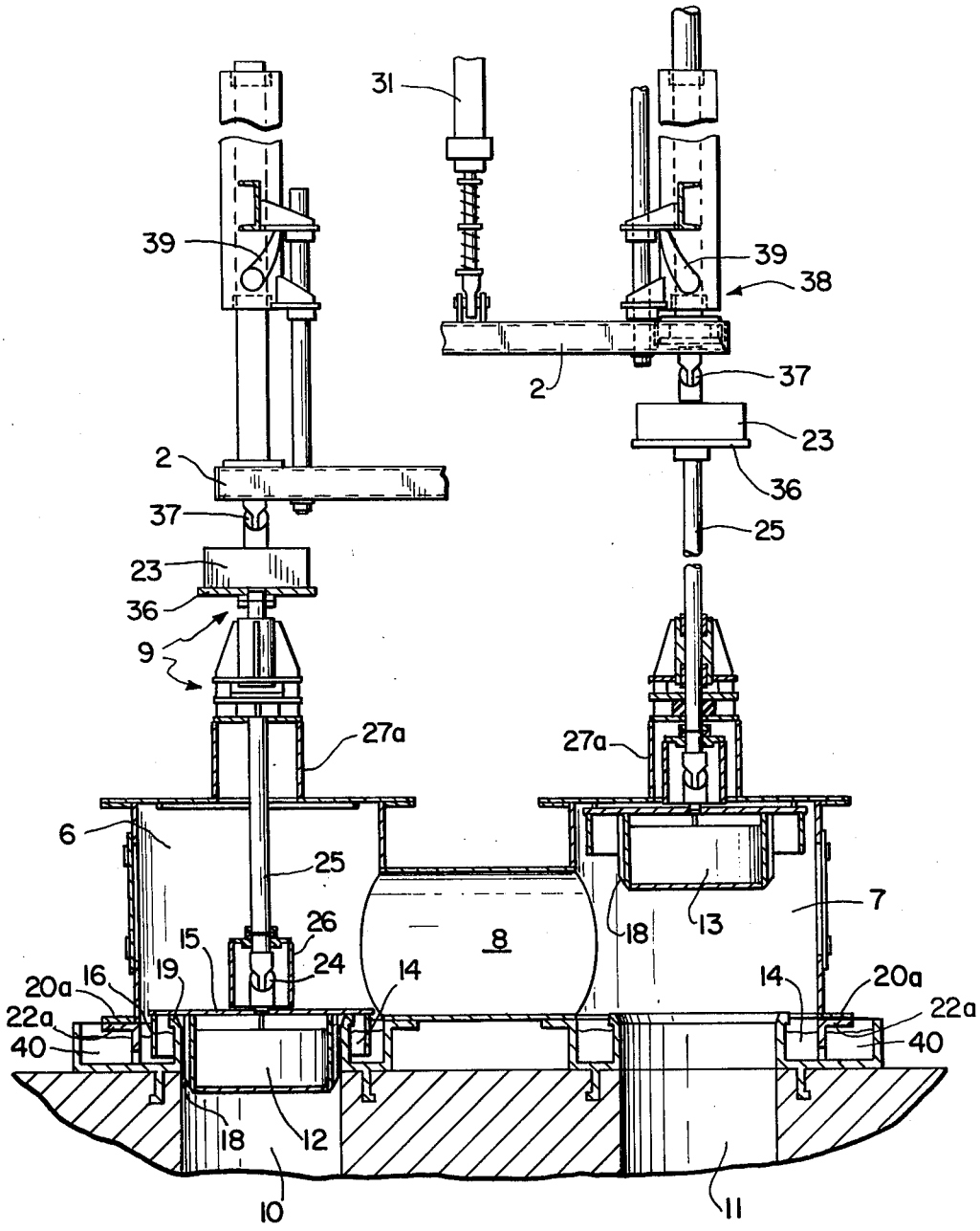
FIG. 3 is a cross sectional view similar to FIG. 1, but of a second embodiment of the present invention.

With reference now to FIG. 3 of the drawings, a second embodiment of the present invention will be described. This embodiment is similar to the embodiment of FIGS. 1 and 2, with the exception that in the embodiment of FIG. 3 the majority of the structure of the transferring apparatus is fixedly and immovably connected to the oven roof. Thus, in this embodiment the housings defining compartments 6, 7 have bottom flanges 20*a* which are fixedly attached to flanges 22*a* of respective ducts 14. The bottom ends of rods 25 are fixedly connected, for example by means of universal joints 24, to cover plates 15 of covers 12, 13. The upper outer ends of rods 25 have attachment devices, for example such as plates 36 formed of a magnetically attractable material, for example iron. Framework 2 which can be moved with the filling cart includes coupling devices, for example electromagnets 23 which are connected to framework 2 by means of ball joints or universal joints 37. A cylinder 31 lifts or lowers framework 2, thereby lifting or lowering joints 37, electromagnets 23, plates 36, rods 25 and thereby covers 12, 13. The lifting device includes respective actuating devices 38 which are associated with cams 39 in a manner such that by lifting or lowering, rotational movement is imparted to joints 37, electromagnets 23, plates 36, rods 25 and thereby the covers 12, 13. This enables the scrappers 18 to remove deposits which may have formed on the inner surfaces of the filling openings and the ducts. In the arrangement shown, there are provided two electromagnets 23. It of course would be possible to provide the lifting device with only a single electromagnet 23, in which case a locking device would be provided to maintain the other rod 25 in the raised position. Each duct 14 may be provided with an exterior water chamber 40 from which water can be fed into the respective duct 14.

The embodiment of the present invention illustrated in FIG. 3 is operated in the following manner. Thus, the housings forming compartments 6, 7 are permanently stationarily mounted above the oven roof. When covers 12, 13 are to be lifted, framework 2 is moved to align electromagnets 23 with plates 36. The electromagnets 23 are then lowered onto plates 36. Cylinder 31 is operated to raise framework 2, joints 37, electromagnets 23, plates 36, rods 25 and covers 12, 13. Actuating devices 38 and cams 39 achieve rotation of covers 12 and 13. Filling gas can now flow from one oven chamber to the other through compartments 6, 7 and transfer duct 8. The gases cannot however escape to the surrounding atmosphere.

As long as covers 12, 13 are submerged with their aprons 16 in the displaceable sealing medium in ducts 14, that is as long as the covers are in their closed positions, no flue gases can enter compartments 6 and 7 form deposits therein.

By rotating covers 12, 13 during the lowering or lifting operation, any deposits in the areas of the edges of the openings are removed.

Although the present invention has been described and illustrated with respect to preferred features thereof, it is to be understood that many variations and modifications of the specifically described and illustrated structural arrangements may be made without departing from the scope of the present invention. For example, separate ring-shaped ducts can be provided for the aprons 16 of the covers and for the aprons 20 of the housings. Furthermore, different coupling or clutching devices than electromagnets 23 may be employed. Furthermore, a single lifting device may be employed for both covers, or each cover may have a separate lifting device.

What we claim is:

1. In a coke oven installation of the type including first and second openings extending through an oven roof into respective oven chambers, and means for transferring between said chambers charging gases which develop during the charging of said chambers while preventing the escape of said gases to the surrounding environment, the improvement wherein said means comprises:

first and second covers movable between first positions closing said first and second openings, respectively, and second positions uncovering said first and second openings, respectively;

ducts peripherally surrounding said first and second openings, said ducts being filled with a displaceable sealing medium;

first and second housings forming respective first and second compartments enclosing said first and second covers, respectively, at all positions thereof;

said first and second covers having respective apron members extending into said dispaceable sealing medium in respective said ducts when said covers are in said first positions thereof, thereby sealing said compartments from the respective said oven chambers;

means for supporting each said cover in said first position thereof and for limiting the extension of the respective said apron member into said displaceable sealing medium when said cover is in said first position thereof, said means comprising an upper plate of said cover abutting an upper surface of an inner wall defining the respective said duct;

said housings having at lower portions thereof means for sealing said compartments from the exterior;

first and second lifting means, associated with respective said housings, for moving said first and second covers, respectively, within said respective compartments between said first and second positions;

each said housing having at an upper portion thereof means for, when the respective said cover is in said second position thereof, sealing the interior of the respective said compartment from the respective said lifting means and from the surrounding environment, said interior sealing means comprising an opening through the top of said housing and through which passes said lifting means upon movement of said cover to said second position thereof, an enclosed casing above said housing and communicating therewith through said opening, a portion of said lifting means being within said casing when said cover is in said second position thereof, and a downwardly facing sealing ring fixed to the top of said housing at a location surrounding said opening, the upper surface of said upper plate of said cover sealingly abutting said sealing ring when said cover is in said second position thereof; and transfer duct means extending between said first and second compartments for, upon said covers being moved from said first positions thereof, transferring charging gases between said chamber openings via said compartments.

2. The improvement claimed in claim 1, wherein said sealing means at said lower portions of said housings comprise members sealingly tightly attached to said oven roof, whereby said housings and said transfer duct means are stationarily fixed to said roof.

3. The improvement claimed in claim 2, wherein each said lifting means includes a member attached to the respective said cover at a position within the respective said compartment.

4. The improvement claimed in claim 3, wherein each said member extends through the respective said housing and said casing and has connected to a portion thereof exterior of the respective said compartment an attachment device, and said lifting means further comprises means for connection to said attachment device and for raising and lowering said attachment device, said member and the respective said cover.

5. The improvement claimed in claim 4, wherein each member comprises a rod extending vertically through the respective said housing and said casing and a universal joint connecting a lower end of said rod to the respective said cover, and each said attachment device comprises a member connected to an upper end of the respective said rod.

6. The improvement claimed in claim 5, wherein each said member connected to said upper end of the respective said rod comprises a magnetically attractable plate, and said raising and lowering means comprises an electromagnet mounted to be brought into contact with said plate and for vertical movement.

7. The improvement claimed in claim 5, further comprising sleeve means surrounding each said universal joint for isolating said joint from said charging gases.

8. The improvement claimed in claim 4, wherein each said cover includes a plug to be fitted in the respective said opening, said plug having thereon scrappers, and said raising and lowering means comprises means for rotating the respective said attachment device, said member and said cover, whereby said scrappers remove deposits from edges of the respective said opening.

9. The improvement claimed in claim 1, wherein said sealing means at said lower portions of said housings comprise aprons extendable downwardly into and removable from said displaceable sealing medium in respective said ducts, said aprons surrounding respective said apron members, whereby said housing and said transfer duct means are removably mounted on said roof.

10. The improvement claimed in claim 9, wherein each said housing has a flange resting on an upper surface of an outer wall of the respective said duct, thereby limiting the downward extension of the respective said apron of said housing into said displaceable sealing medium.

11. The improvement claimed in claim 9, wherein each said lifting means includes a coupling device removably connectable to the respective said cover at a position within the respective said compartment.

12. The improvement claimed in claim 11, wherein each said lifting means further includes a member connected to the respective said coupling device and extending through the respective said housing and said casing, and means connected to an outer portion of said member for raising and lowering said member, said coupling device, and the respective said cover.

13. The improvement claimed in claim 12, wherein each said member comprises a rod extending vertically through the respective said housing and said casing, and a universal joint connecting a lower end of said rod to the respective said coupling device.

14. The improvement claimed in claim 13, wherein each said upper plate of said covers comprises a magnetically attractable material, and each said coupling device comprises an electromagnet.

15. The improvement claimed in claim 13, further comprising sleeve means surrounding each said universal joint for isolating said joint from said charging gases.

16. The improvement claimed in claim 12, wherein each said cover includes a plug to be fitted in the respective said opening, said plug having thereon scrappers, and said raising and lowering means comprises means for rotating the respective said member, said coupling device and said cover, whereby said scrappers remove deposits from edges of the respective said opening.

17. The improvement claimed in claim 9, further comprising a supporting framework mounted for movement to and away from said roof, and means for connecting said housings to said framework such that said housings and said transfer duct means are movable with said framework.

18. The improvement claimed in claim 17, wherein said connecting means include universal joints.

19. The improvement claimed in claim 1, wherein said transfer duct means comprises a pipe connected to said housings and opening freely into said compartments.

20. The improvement claimed in claim 1, wherein each said lifting means includes a member sealingly slidably extending through a hole in the top of the respective said casing, thereby forming a secondary seal for sealing the respective said compartment from the surrounding environment.

21. An apparatus, for use in a coke oven of the type including first and second openings extending through an oven roof into respective oven chambers, for transferring between the chambers charging gases which develop during the charging of the chambers while preventing the escape of the gases to the surrounding environment, said apparatus comprising:

first and second covers adapted to be mounted for movement between first positions adapted to close first and second openings, respectively, in an oven roof and second positions adapted to uncover such first and second openings, respectively;

ducts adapted to peripherally surround the first and second openings, said ducts being filled with a displaceable sealing medium;

first and second housings forming respective first and second compartments enclosing said first and second covers, respectively, at all positions thereof;

said first and second covers having respective apron members extending into said displaceable sealing medium in respective said ducts when said covers are in said first positions thereof, thereby sealing said compartments from the respective said oven chambers;

means for supporting each said cover in said first position thereof and for limiting the extension of the respective said apron member into said displaceable sealing medium when said cover is in said first position thereof, said means comprising an upper plate of said cover abutting an upper surface of an inner wall defining the respective said duct;

said housings having at lower portions thereof means for sealing said compartments from the exterior;

first and second lifting means, associated with respective said housings, for moving said first and second covers, respectively, within said respective compartments between said first and second positions;

each said housing having at an upper portion thereof means for, when the respective said cover is in said second position thereof, sealing the interior of the respective said compartment from the respective said lifting means and from the surrounding environment, said interior sealing means comprising an opening through the top of said housing and through which passes said lifting means upon movement of said cover to said second position thereof, an enclosed casing above said housing and communicating therewith through said opening, a portion of said lifting means being within said casing when said cover is in said second position thereof, and a downwardly facing sealing ring fixed to the top of said housing at a location surrounding said opening, the upper surface of said upper plate of said cover sealingly abutting said sealing ring when said cover is in said second position thereof; and transfer duct means extending between said first and second compartments for, upon said covers being moved from said first positions thereof, transferring charging gases between the chamber openings via said compartments.

22. An apparatus as claimed in claim 21, wherein said sealing means at said lower portions of said housings comprise members sealingly tightly attached to respective said ducts, whereby said housings and said transfer duct means are adapted to be stationarily fixed to the oven roof.

23. An apparatus as claimed in claim 22, wherein each said lifting means includes a member attached to the respective said cover at a position within the respective said compartment.

24. An apparatus as claimed in claim 23, wherein each said member extends through the respective said housing and said casing and has connected to a portion thereof exterior of the respective said compartment an attachment device, and said lifting means further comprises means for connection to said attachment device and for raising and lowering said attachment device, said member and the respective said cover.

25. An apparatus as claimed in claim 24, wherein each said member comprises a rod extending vertically through the respective said housing and said casing and a universal joint connecting a lower end of said rod to the respective said cover, and each said attachment device comprises a member connected to an upper end of the respective said rod.

26. An apparatus as claimed in claim 25, wherein each said member connected to said upper end of the respective said rod comprises a magnetically attractable plate, and said raising and lowering means comprises an electromagnet mounted to be brought into contact with said plate and for vertical movement.

27. An apparatus as claimed in claim 25, further comprising sleeve means surrounding each said universal joint for isolating said joint from the charging gases.

28. An apparatus as claimed in claim 24, wherein each said cover includes a plug to be fitted in the respective opening, said plug having thereon scrappers, and said raising and lowering means comprises means for rotating the respective said attachment device, said member and said cover, whereby said scrappers remove deposits from edges of the respective opening.

29. An apparatus as claimed in claim 21, wherein said sealing means at said lower portions of said housings comprises aprons extendable downwardly into and removable from said displaceable sealing medium in respective said ducts, said aprons surrounding respective said apron members, whereby said housings and said transfer duct means are adapted to be removably mounted on the oven roof.

30. An apparatus as claimed in claim 29, wherein each said housing has a flange resting on an upper surface of an outer wall of the respective said duct, thereby limiting the downward extension of the respective said apron of said housing into said displaceable sealing medium.

31. An apparatus as claimed in claim 29, wherein each said lifting means includes a coupling device removably connectable to the respective said cover at a position within the respective said compartment.

32. An apparatus as claimed in claim 31, wherein each said lifting means further includes a member connected to the respective said coupling device and extending through the respective said housing and said casing, and means connected to an outer portion of said member for raising and lowering said member, said coupling device, and the respective said cover.

33. An apparatus as claimed in claim 32, wherein each said member comprises a rod extending vertically through the respective said housing and said casing, and a universal joint connecting a lower end of said rod to the respective said coupling device.

34. An apparatus as claimed in claim 33, wherein each said upper plate of said covers comprises a magnetically attractable material, and each said coupling device comprises an electromagnet.

35. An apparatus as claimed in claim 33, further comprising sleeve means surrounding each said universal joint for isolating said joint from the charging gases.

36. An apparatus as claimed in claim 32, wherein each said cover includes a plug to be fitted in the respective opening, said plug having thereon scrappers, and said raising and lowering means comprises means for rotating the respective said member, said coupling device and said cover, whereby said scrappers remove deposits from edges of the respective opening.

37. An apparatus as claimed in claim 29, further comprising a supporting framework adapted to be mounted for movement to and away from the oven roof, and means for connecting said housings to said framework such that said housings and said transfer duct means are movable with said framework.

38. An apparatus as claimed in claim 37, wherein said connecting means include universal joints.

39. An apparatus as claimed in claim 21, wherein said transfer duct means comprises a pipe connected to said housings and opening freely into said compartments.

40. An apparatus as claimed in claim 21, wherein each said lifting means includes a member sealingly slidably extending through a hole in the top of the respective said casing, thereby forming a secondary seal for sealing the respective said compartment from the surrounding environment.

* * * * *